US008116641B2

(12) United States Patent
Soutome

(10) Patent No.: US 8,116,641 B2
(45) Date of Patent: Feb. 14, 2012

(54) IMAGE-FORMING DEVICE

(75) Inventor: Kiyonori Soutome, Ibaraki (JP)

(73) Assignee: Canon Finetech Inc. (JP)

( * ) Notice: Subject to any disclaimer, the term of this patent is extended or adjusted under 35 U.S.C. 154(b) by 0 days.

(21) Appl. No.: 11/332,421

(22) Filed: Jan. 13, 2006

(65) Prior Publication Data

US 2006/0193649 A1 Aug. 31, 2006

(30) Foreign Application Priority Data

Jan. 14, 2005 (JP) ..... 2005-007130

(51) Int. Cl.
*G03G 15/08* (2006.01)

(52) U.S. Cl. ..... 399/27; 399/30; 399/61

(58) Field of Classification Search ..... 399/27, 399/24, 30, 61
See application file for complete search history.

(56) References Cited

U.S. PATENT DOCUMENTS

| | | | | |
|---|---|---|---|---|
| 4,660,152 | A * | 4/1987 | Downing et al. | |
| 4,786,869 | A * | 11/1988 | Kanai et al. | |
| 5,237,372 | A * | 8/1993 | Ishii et al. | |
| 5,387,965 | A * | 2/1995 | Hasegawa et al. | |
| 5,946,522 | A * | 8/1999 | Inami | 399/27 |
| 6,397,017 | B1 * | 5/2002 | Sakai et al. | 399/27 |
| 6,397,018 | B1 * | 5/2002 | Matsumoto et al. | 399/27 |
| 6,542,704 | B2 * | 4/2003 | Suetsugu | |
| 6,591,070 | B1 * | 7/2003 | Shoji et al. | 399/27 |
| 6,668,141 | B2 * | 12/2003 | Kojima et al. | 399/27 |
| 6,912,366 | B1 * | 6/2005 | Yamamoto et al. | 399/27 |
| 6,925,267 | B2 * | 8/2005 | Yamamoto et al. | 399/27 |
| 6,931,216 | B2 * | 8/2005 | Mochizuki et al. | 399/27 |
| 7,505,699 | B2 * | 3/2009 | Harada et al. | 399/27 |
| 7,532,828 | B2 * | 5/2009 | Komiya et al. | |
| 7,630,655 | B2 * | 12/2009 | Namiki et al. | |
| 7,684,715 | B2 * | 3/2010 | Zaima | 399/27 |
| 7,720,402 | B2 * | 5/2010 | Watanabe | 399/74 |
| 7,747,180 | B2 * | 6/2010 | Wittenauer et al. | 399/27 |
| 2003/0053809 | A1 * | 3/2003 | Ogata et al. | 399/12 |
| 2006/0222388 | A1 * | 10/2006 | DiRubio et al. | |
| 2007/0196115 | A1 * | 8/2007 | Soutome | |
| 2010/0054764 | A1 * | 3/2010 | Nishikawa | 399/27 |

FOREIGN PATENT DOCUMENTS

| | | |
|---|---|---|
| JP | 2001-142290 | 5/2001 |
| JP | 2001-228697 | 8/2001 |
| JP | 2003-122107 | 4/2003 |
| JP | 2003-186296 | 7/2003 |
| JP | 2004-086176 | 3/2004 |

* cited by examiner

*Primary Examiner* — David Gray
*Assistant Examiner* — Geoffrey T Evans
(74) *Attorney, Agent, or Firm* — Reed Smith LLP

(57) ABSTRACT

The image forming device, by providing an amount of toner remaining detection system, calculates the amount of relative change in the electrostatic capacitance in the amount of toner remaining over a prescribed number of sheets of recording paper (R) to sense the amount of toner remaining, and indicates that the amount of toner remaining is too low when it is judged that the amount of relative change in the electrostatic capacitance of said amount of toner remaining exceeds a reference amount of change, sensing of the amount of toner remaining and indication that it is too low are performed based on the relative change in one sensing signal relating to the amount of toner remaining, comparing two sensing signals relating to the amount of toner remaining as in the past is eliminated, and the process for adjusting the sensing output is made unnecessary.

3 Claims, 6 Drawing Sheets

| Memory storage data | |
|---|---|
| Data no. | Average antenna voltage signal (V) |
| n | Xn |
| n-1 | Xn-1 |
| n-2 | Xn-2 |
| n-3 | Xn-3 |
| n-4 | Xn-4 |
| ⋮ | ⋮ |
| n-p | Xn-p |

* Number of data stored is up to P

| Memory storage data | |
|---|---|
| Data no. | Average antenna voltage signal (V) |
| n | Xn |
| n-1 | Xn-1 |

* Number of data stored is up to 2

| Memory storage data | |
|---|---|
| Data no. | $Yn \geqq Yc$ ? |
| n | 1 or 0 |
| n-1 | 1 or 0 |
| n-2 | 1 or 0 |
| n-3 | 1 or 0 |
| n-4 | 1 or 0 |
| ⋮ | ⋮ |
| n-p | 1 or 0 |

* Number of data stored is up to q

IMAGE-FORMING DEVICE

CROSS-REFERENCE TO RELATED APPLICATIONS

The present application is based on Japanese Patent Application JP2005-007130 filed on Jan. 14, 2005, the contents of which are incorporated herein by reference.

FIELD OF THE INVENTION

The present invention relates to an image-forming device equipped with a remaining amount of toner detection system that indicates when the amount of toner remaining in the developer storage container is excessively low.

BACKGROUND OF THE INVENTION

Generally, various image-forming devices, such as copiers, fax machines, printers and the like are furnished with an amount of toner remaining detection system that senses the amount of toner remaining in a developer storage container, and when the amount of toner remaining falls below a preset reference value, indicates on an indicator part that the amount of toner remaining in the aforementioned developer storage container is too low.

Concerning such amount of toner remaining detection systems, those known in the past are such that an antenna is disposed in the developer storage container to sense the amount of toner remaining from the electrostatic capacitance of the remaining toner, for example in patent references Japanese Kokai Patent Application No. 2001-228697, Japanese Kokai Patent Application No. 2003-122107, and Japanese Kokai Patent Application No. 2004-086176. With those that use an antenna, as shown in FIG. 10 for example, a rod-shaped antenna (3) is disposed buried inside toner (Tn) to face developing sleeve (2*b*) inside toner storage container (2*a*) of developing unit (2) disposed close to image carrier (1), e.g., a photosensitive drum or the like. An electrostatic capacitance sensing circuit (3*a*) is connected to antenna (3), and an electrostatic capacitance sensing circuit (3*c*) is also connected to reference capacitor (3*b*) that is supplied with power from power source (2*c*) of aforementioned developing sleeve (2*b*). Then the electrostatic capacitance output from electrostatic capacitance sensing circuit (3*c*) on the capacitor (3*b*) side and the electrostatic capacitance output from electrostatic capacitance sensing circuit (3*a*) on the abovementioned antenna (3) side are compared by comparator (3*d*) and the amount of toner remaining in aforementioned toner storage container (2*a*) is sensed from the comparison result.

Detecting the electrostatic capacitance of the remaining toner with a sensing mechanism other than an antenna has also been proposed, as in Japanese Kokai Patent Application No. 2003-186296, for example, but in all cases, they are constituted so that the amount of toner remaining sensing signal obtained with any of these amount of toner remaining detection systems is received by a print control means (CPU) (4) on the printing and recording engine side, omitted from the figure, and approval/disapproval of the image-forming process is controlled by print control means (CPU) (4). That is, when it is judged that the amount of toner remaining sensed with the amount of toner remaining system described above has fallen below a preset reference value, the fact that the amount of toner remaining is too low is indicated on an operating and indication part, omitted from the figure.

However, in such a conventional amount of toner remaining detection system, two sensing signals, a sensing signal from antenna (3) and a sensing signal from power source (2*c*), are used as described above and the two sensing signals are compared. However, in the initial state of the two sensing signals, fluctuation is readily produced depending on the circuit board adjustment process during factory shipping and there is a risk of error in the sensing of the amount of toner remaining corresponding to the difference between the two sensing signals. For example, when the initial setting of the difference between the aforementioned two sensing signals is too large, images called white voids appear before indication that the amount of toner remaining is too low. And when the initial setting of the aforementioned two sensing signals is too small, indication that the amount of toner remaining is too low may occur even if a sufficient amount of toner remains.

For this reason, in the past, initial adjustment of the two sensing signals relating to the amount of toner remaining described above was strictly managed during factory shipping, but with such a strict adjustment process, there is a risk of reducing the overall device productivity.

The objective of the present invention is to provide an image-forming device that can basically eliminate the initial adjustment in the amount of toner remaining detection system.

SUMMARY OF THE INVENTION

In order to accomplish the aforementioned objective, with the image-forming device pertaining to one embodiment of the present invention, in an image-forming device equipped with an amount of toner remaining detection system that senses the amount of toner remaining in a developer storage container and that senses that there is no toner when the sensed amount of toner remaining is too low, the aforementioned amount of toner remaining detection system is constituted so that the presence or absence of toner in the aforementioned developer storage container is sensed by calculating the electrostatic capacitance relating to the remaining toner in the aforementioned developer storage container as a relative amount of change over a prescribed number of sheets of recording paper for forming images.

In the image-forming device it is possible to sense the amount of toner remaining and indicate that it is too low based on the relative change in one sensing signal relating to the amount of toner remaining by calculating and monitoring the relative amount of change in the remaining toner electrostatic capacitance over multiple sheets of recording paper. Because two sensing signals relating to the amount of toner remaining are not compared as in the past, the process for adjusting the sensing output basically becomes unnecessary.

With the image-forming device pertaining to another embodiment of the present invention, the amount of toner remaining detection system in aforementioned is constituted such that no toner is determined when the amount of relative change in the electrostatic capacitance of the remaining toner exceeds a preset reference amount of change.

In the image-forming device, the relative amount of change in the value for the amount of toner remaining is obtained with a relatively simple calculation procedure as well as with good precision.

In addition, with the image-forming device pertaining to another embodiment of the present invention, the amount of toner remaining detection system is constituted such that the electrostatic capacitance relating to the toner remaining in the developer storage container is sensed using a fixed number of sheets of recording paper for forming images as a unit, the electrostatic capacitance of the remaining toner for the aforementioned unit is stored sequentially each time an image-forming operation using the fixed number of recording sheets sensed as a unit is completed, and at the same time, the electrostatic capacitance of the remaining toner not corresponding to the recording paper for calculating the relative amount of change in the electrostatic capacitance of the remaining toner for one unit is sequentially erased.

In the image-forming device calculating the value of the amount of toner remaining may be accomplished with the storage capacity for the electrostatic capacitance of the amount of toner remaining for each sheet of recording paper minimized, with the result that the device can be made less expensive and smaller.

In addition, with the image-forming device pertaining to yet another embodiment of the present invention, the amount of toner remaining detection system is characterized in that the number of sheets in a range in which white voids in the images will not occur when the amount of toner remaining is too low is set as the prescribed number of sheets of recording paper for calculating the relative amount of change in the electrostatic capacitance of the remaining toner.

With the image-forming device having such a constitution, while ignoring a sudden change in or incorrect detection of the relative amount of change in the electrostatic capacitance of the remaining toner, white voids in images will be prevented and satisfactory image quality will be maintained.

As described above, the image-forming device is provided with an amount of toner remaining detection system that calculates the relative change in amount in the electrostatic capacitance of said remaining toner over a prescribed number of sheets of recording paper to sense the amount of toner remaining and thus senses the amount of toner remaining and indicates that it is too low based on the relative change in one sensing signal relating to the amount of toner remaining, does not compare two sensing signals relating to the amount of toner remaining as in the past, and makes the process for adjusting sensing output unnecessary. So, the initial adjustment in the amount of toner remaining detection system can basically be eliminated and the indication relating to the amount of toner remaining can be accomplished easily and with high precision.

In the image-forming device, the amount of toner remaining detection system is constituted such that no toner is determined when the relative amount of change in the remaining toner electrostatic capacitance for every unit of recording paper exceeds a preset reference amount of change, and thus the relative amount of change in the value of the amount of toner remaining is obtained with a relatively simple calculation procedure as well as with good precision. So, the effects described above can be obtained reliably.

In addition, in the image-forming device, the amount of toner remaining detection system is constituted such that the electrostatic capacitance of the aforementioned remaining toner is sequentially stored each time an imaging-forming operation using a fixed number of sheets of recording paper as a unit is completed, and at the same time, the electrostatic capacitance of the remaining toner not corresponding to the recording paper for calculating the relative amount of change in the electrostatic capacitance of the remaining toner for one unit is sequentially deleted. Thus, it is sufficient for the storage capacity for the electrostatic capacitance of the remaining toner for each sheet of recording paper to be at a minimum for calculating the value of the amount of toner remaining. So, in addition to the effects described above, lower cost and miniaturization of the device can be achieved.

In addition, the image-forming device of the present invention is such that a range of number of sheets in which white voids in images will not occur is set in the amount of toner remaining detection system as the prescribed number of sheets of recording paper for calculating the amount of relative change of the electrostatic capacitance of the remaining toner. While ignoring a sudden change in or incorrect detection of a relative amount of change in the electrostatic capacitance of the remaining toner, white voids in images will be prevented and satisfactory image quality will be maintained. So, the effects described above can be obtained without degrading the image-forming performance.

DETAILED DESCRIPTION OF THE DRAWINGS

Figure 1:
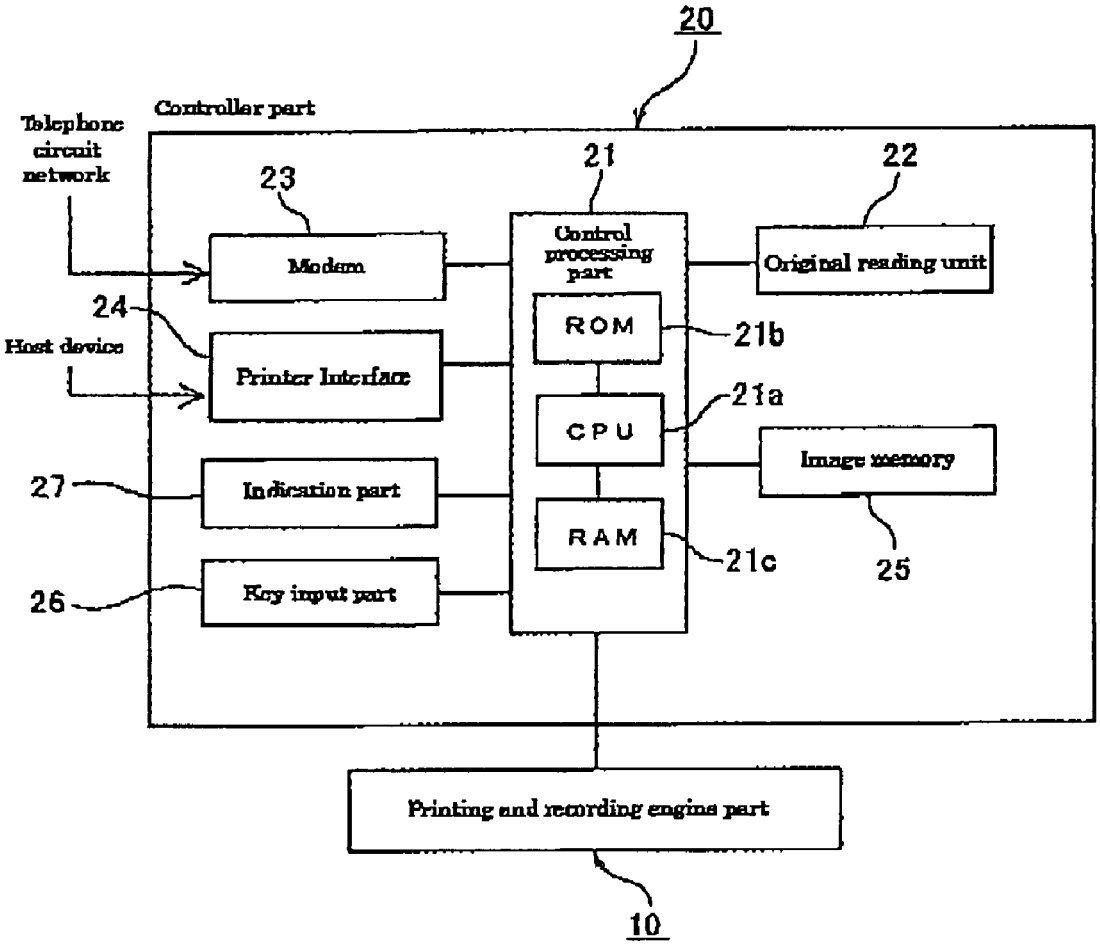
FIG. 1 is a schematic block line drawing representing the general structure of a controller that includes an amount of toner remaining detection system in an embodiment of the present invention.

First, as shown in FIG. 1, the entire image-forming device is constituted from a printing and recording engine part (10) that executes various operations for image formation and a controller part (20) that controls the various operations in printing and recording engine part (10). Various control signals from control processing part (21) furnished for aforementioned controller part (20) are output to aforementioned printing and recording engine part (10).

A ROM (21*b*) in which various control programs, such as the amount of toner remaining detection system as described below, are stored, and a RAM (21*c*) in which various data are stored during control program execution are connected to a CPU (central processing unit) (21*a*) of control processing part (21) furnished inside aforementioned controller part (20), and a scanner part (original reading unit) (22) used for copy (reproduction) functions, a fax modem (23) that receives image data from a telephone circuit network, and a printer interface (24) that receives image data from external host devices are connected to control processing part (21). Multiple types of image data are incorporated into aforementioned control processing part (21) through the three image data incorporation parts (22), (23) and (24). Image data incorporated through the three image data incorporation parts (22), (23) and (24) are stored in image memory (25) connected to aforementioned control processing part (21).

A key input part (26) that outputs operating instruction signals is also connected to aforementioned control processing part (21), and an indication part (27) that indicates the device operating status, operating messages and the like is also connected. Then, after image data output as necessary based on the operating instructions or received content are stored in aforementioned image memory (25), the appropriate image-forming operation (print operation) is executed by video signals based on the image data being output to aforementioned printing and recording engine part (10) along with various control signals, and while the image formation operation (print operation) is in progress, detection of the amount of toner remaining is executed as described below.

Figure 2:
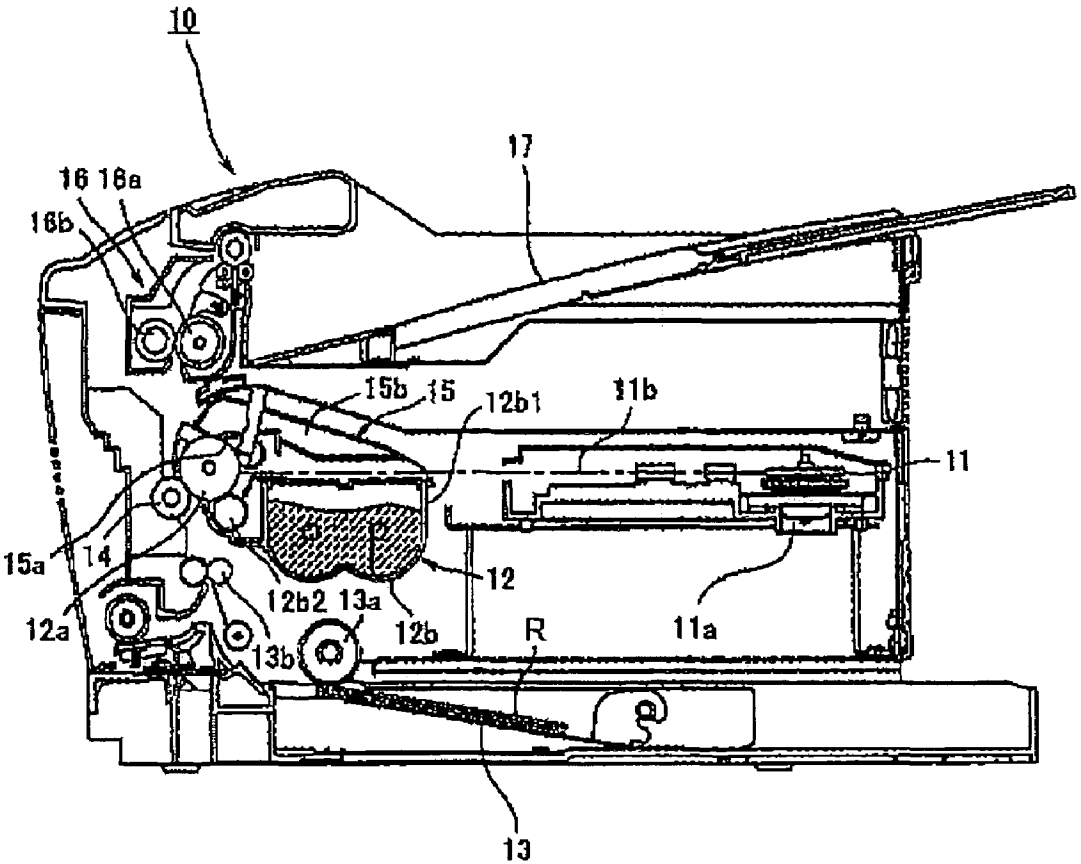
FIG. 2 is a longitudinal sectional explanatory diagram representing an example of the overall structure of the printing and recording engine part for carrying out the image-forming process.

On the other hand, aforementioned printing and recording engine part (10) is constituted as shown in FIG. 2, for example. Optical modulation information (11*b*) is produced by polygonal mirror (11*a*) of laser scanner unit (11) being rotated synchronously according to image data and various control signals output from abovementioned controller part (20). Optical modulation information (11*b*) forms an image as light spots on photosensitive drum (12*a*) as the image carrier furnished in process cartridge (12). While the light spots are turned on and off, an electrostatic latent image corresponding to the formed image is formed on said photosensitive drum (12*a*) by scanning back and forth in the axial orientation (main scanning orientation) of aforementioned photosensitive drum (12*a*). Then, an unfixed toner image is formed on photosensitive drum (12*a*) by toner stored in toner (developer) storage container (12*b*l) of developing unit (12*b*) furnished integrally inside the same process cartridge (12) being supplied through developing sleeve (12*b*2) to the electrostatic latent image on aforementioned photosensitive drum (12*a*).

On the other hand, recording paper (R) stored in the paper feed part of paper feed cassette (13) is disposed in the lower part of the device. Recording paper (R) in paper feed cassette (13) is pulled out by paper feed roller (13*a*) that is rotated through a paper feed clutch from a conveyor motor, not shown. Due to the sensing of the end of the aforementioned recording paper (R) by a TOP sensor that is omitted from the figure, it is conveyed by the action of resist roller (13*b*) while the appropriate timing is achieved, and thus is fed into the transfer region facing abovementioned photosensitive drum (12*a*).

A transfer roller (14) is disposed in the transfer region of photosensitive drum (12*a*) to contact the surface of said photosensitive drum (12*a*). A transfer bias under the control of a high-voltage controller part is impressed onto transfer roller (14) and the unfixed toner image on aforementioned photosensitive drum (12*a*) is electrostatically transferred onto recording paper (R) by the transfer bias. Toner remaining on aforementioned photosensitive drum (12*a*) after transfer is separated to be scraped away by the sliding contact force of cleaning blade (15*a*) disposed to be pressed onto the surface of said photosensitive drum (12*a*). Waste toner scraped away by cleaning blade (15*a*) is constituted to be stored in waste toner storage part (15*b*) furnished in cleaning unit (15) that holds said cleaning blade (15*a*).

In addition, recording paper (R) carrying the unfixed toner due to the abovementioned transfer operation is conveyed toward fixing unit (16) disposed near a position just above aforementioned process cartridge (12). A pressure roller (16*a*) and a pressure roller (16*b*) as heater are furnished for aforementioned fixing unit (16). The unfixed toner image on aforementioned recording paper (R) is heated and heat-melt fixing is performed by pressure roller (16*a*) and pressure roller (16*b*), with the result that the toner image is affixed on aforementioned recording paper (R). Recording paper (R) to which the toner image is affixed by such a heat fixing operation is delivered to paper delivery tray (17) at the upper part of the device.

At this time, the amount of toner remaining in toner storage container (12*b*1) of abovementioned developing unit (12*b*) is sensed by removing the voltage induced in the antenna (refer to symbol (3) in FIG. 10) buried inside the toner as explained already in the prior art section, and the amount of toner remaining detection operation is continually performed as below during the image formation operation (print operation) by an amount of toner remaining detection system that includes the aforementioned antenna.

Figure 3:
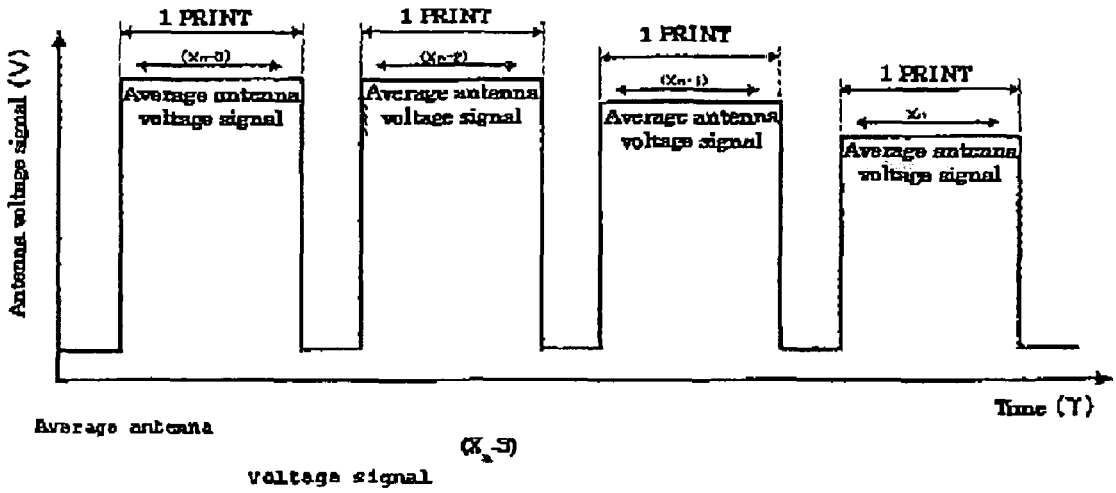
FIG. 3 is a line drawing that schematically represents the average antenna voltage signal distribution with the antenna voltage signals from the amount of toner remaining detection system averaged for each sheet of recording paper.

That is, the analog detection signal output from the aforementioned antenna of the amount of toner remaining detection system is continually sampled at extremely small intervals of 2-3 msec, for example, during the image formation operation (print operation), and 100 sampling signals x, that is, over 0.2-0.3 sec, are treated as a 1 block section. Then, the average value $x_k$ of the sampling signals in one block section is calculated, the average value $X_k$ of the number ($x_1$, $x_2, \ldots, x_n$) of average values $x_k$ of each of the aforementioned sampling signals corresponding to one sheet of recording paper is calculated when the image-forming operation (print operation) for one sheet of recording paper is completed. With this, the average antenna voltage signal ($X_1$, $X_2, \ldots,$ $X_k, \ldots, X_n$) for each sheet of recording paper (R) shown in FIG. 3, for example, that is, the average amount of toner remaining value based on the electrostatic capacitance of the amount of toner remaining immediately after one sheet of recording paper (R) is printed, is obtained so that a rectangular shape is obtained for each sheet of recording paper (R).

Figure 4:
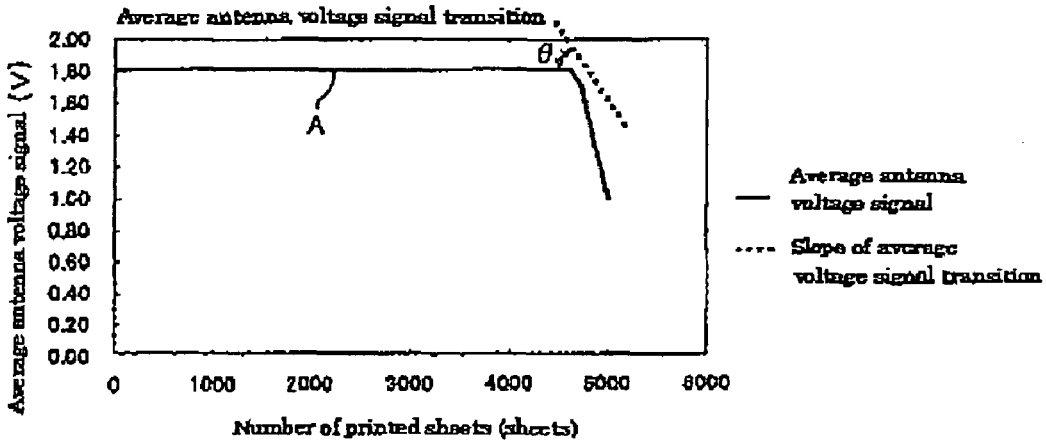
FIG. 4 is a line drawing that schematically represents the overall transition of the amount of toner remaining obtained with an amount of toner remaining detection system.

The relationship between the average antenna voltage signal ($X_1, X_2, \ldots, X_n$) as the average amount of toner remaining value based on the electrostatic capacitance of the amount of toner remaining and the number of sheets of recording paper (R) on which images are formed (number of printed sheets) can be broadly represented by characteristic curve A as shown in FIG. 4, for example. When the amount of toner remaining in abovementioned toner storage container (12*b*1) starts to decline suddenly at the point when the number of sheets of recording paper (R) on which images are formed (number of printed sheets), which is the horizontal axis in this case, reaches a specific number of sheets, corresponding to this, average antenna voltage signal curve A, which is the average amount of toner remaining value based on the electrostatic capacitance of the amount of toner remaining described above, also suddenly starts to fall.

From this fact, in the amount of toner remaining detection system in this embodiment, slope θ of abovementioned average antenna voltage signal curve A, that is, the relative amount of change in the average amount of toner remaining value for each sheet of recording paper (R) is calculated as below.

Figures 5, 6:
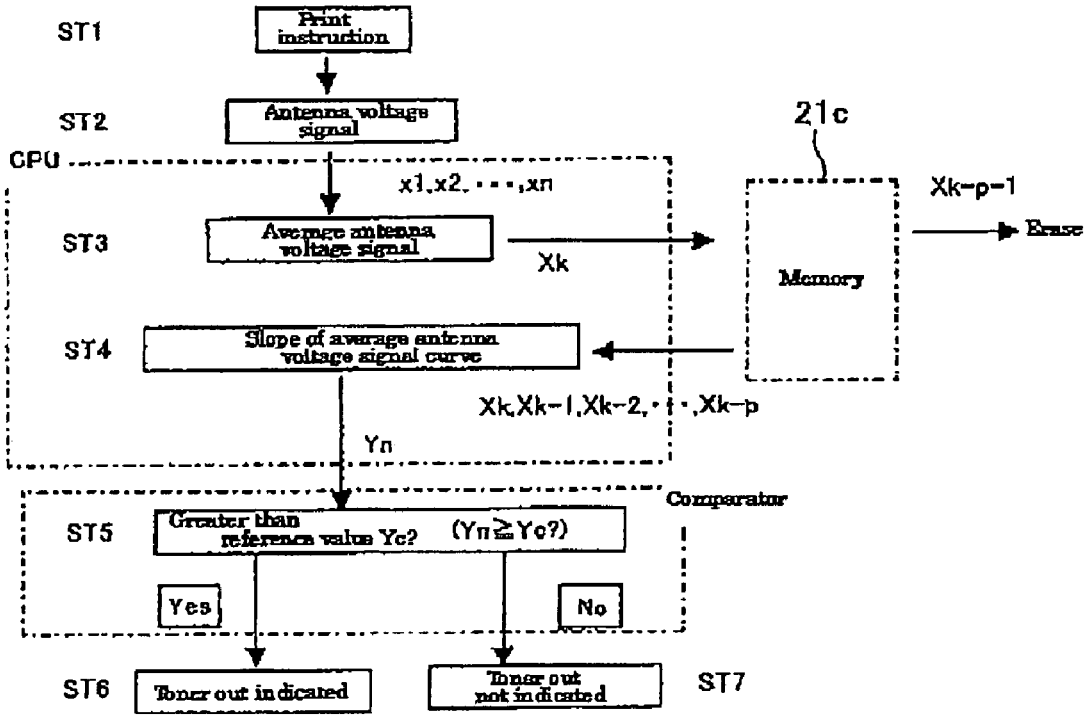
FIG. 5 is a flow chart representing the detection procedure for the amount of toner remaining in an embodiment of the present invention.
FIG. 6 is a schematic diagram representing how the amount of toner remaining data (average antenna voltage signals) are stored in memory in the embodiment in FIG. 5.
Figures 9, 10:
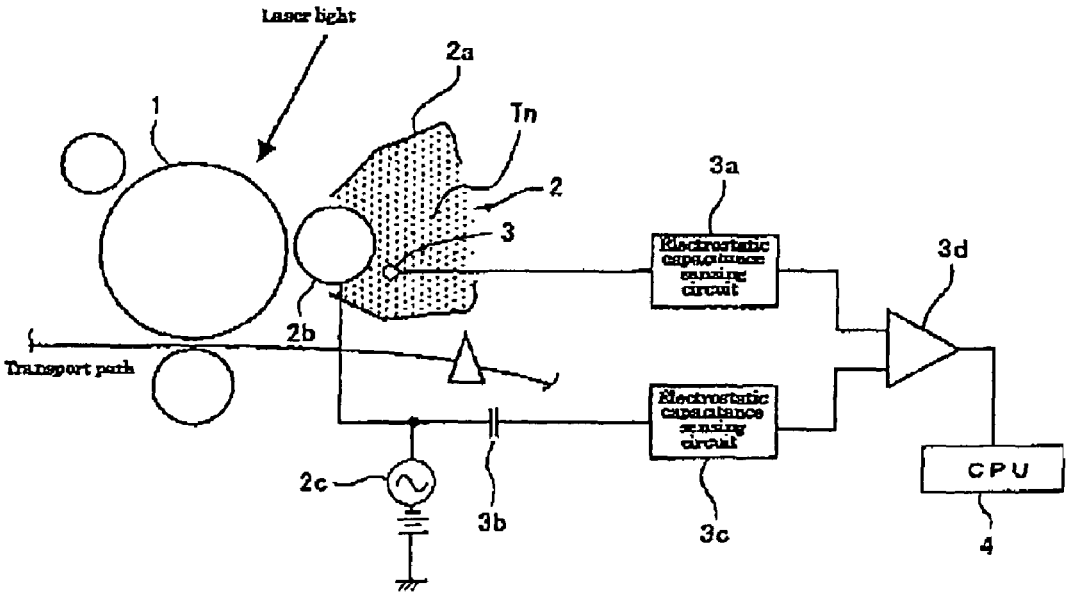
FIG. 9 is a schematic diagram representing how decision data for the amount of toner remaining are stored in memory in the embodiment in FIG. 7.
FIG. 10 is a longitudinal sectional explanatory diagram representing the schematic constitution of a typical amount of toner remaining detection system.

That is, with the embodiment shown in FIG. 5, first, when the image formation operation (print operation) is started by a print instruction being issued (step 1), simultaneously with this, antenna voltage signal x is output from the aforementioned antenna (refer to symbol (3) in FIG. 10) of the amount of toner remaining detection system (step 2). Then, using the antenna voltage signal, average antenna voltage signal $X_k$ ($X_1$, $X_2$, . . . , $X_n$), which is the average amount of toner remaining based on the electrostatic capacitance of the amount of toner remaining for each sheet of recording paper (R) described above, is calculated using one sheet, which is a fixed number of sheets of recording paper (R), as a unit (step 3).

The average antenna voltage signals $X_k$ corresponding to the remaining toner electrostatic capacitance for one unit that is one sheet of recording paper (R) are sequentially stored in a memory (RAM) (21*c*) furnished in control processing part (21) of abovementioned controller part (20). In this case, with this embodiment, as shown in FIG. 6, only average antenna voltage signals ($X_k$, $X_{k-1}$, . . . , $X_{k-p}$) in a range going back by a prescribed number of sheets (P) of recording paper (R) from the most recent average antenna voltage signal $X_k$ at the present time are stored in aforementioned memory (21*c*). Simultaneously with storage of the most recent average antenna voltage signal $X_{k-p-1}$, the average antenna voltage signal of the (P+1)th sheet prior to that is erased.

In particular in this embodiment, the prescribed number of sheets (P) for the average antenna voltage signal $X_k$ as the average amount of toner remaining value based on the electrostatic capacitance of the abovementioned amount of toner remaining stored in memory (21*c*) is set to 10 sheets. In this way, sudden changes or erroneous detection such as replacement of developing unit (12*b*), ambient changes, or the like will be ignored by using the average amount of toner remaining value corresponding to the prescribed number of sheets (10 sheets). In particular, the abovementioned prescribed number of sheets (P) is set at 10 sheets because the upper limit of the number of sheets at which printing can be accomplished after the fact that the amount of toner remaining is too low is indicated and no white voids occur is around 10 sheets, as will be described below.

For such reasons, the average antenna voltage signals ($X_k$, $X_{k-1}$, . . . , $X_{k-10}$) going back 10 sheets of recording paper (R) from the most recent average antenna voltage signal $X_k$ are read into abovementioned control processing part (21) from aforementioned memory (21*c*), and in control processing part (21), an approximation curve for the average antenna voltage signals ($X_k$, $X_{k-1}$, . . . , $X_{k-10}$) corresponding to 10 sheets of recording paper (P) is calculated and slope $Y_k$ of the abovementioned average antenna voltage signal curve (refer to FIG. 4) is obtained (step 4) from the slope θ of the approximation curve being calculated.

Slope $Y_k$ of the average antenna voltage signal curve represents the amount of relative change in the amount of toner remaining at the present time in abovementioned developing unit (12*b*). Slope $Y_k$ is compared to a preset reference value $Y_C$ using a comparator that is omitted from the figure (step 5). The result is that when slope $Y_k$ of the average antenna voltage signal curve exceeds reference value $Y_C$, it is judged that the amount of relative change of the amount of toner remaining has suddenly increased, the fact that the amount of toner remaining is too low is indicated and an indication such as "Toner out" or "Toner empty" is output to indication part (27) (step 6). When it is judged that slope $Y_k$ of the average antenna voltage signal curve is below abovementioned reference value $Y_c$, there is no indication that the amount of toner remaining is too low (step 7).

In this embodiment in this way, the amount of toner remaining in developing unit (12*b*) is sensed based on the slope $Y_k$ of the average antenna value signal curve, which is one sensing signal relating to said amount of toner remaining that is based on the relative change in the amount of toner remaining itself, and it is indicated that the amount of toner remaining is too low. So, there is no comparison of two sensing signals relating to the amount of toner remaining as in the past and the process for adjusting the sensing output basically becomes unnecessary.

In this case, with this embodiment, because slope $Y_k$ of the average antenna voltage signal curve A calculated over a prescribed number of sheets (10 sheets) of recording paper (R) is used as the amount of relative change in the amount of toner remaining, the relative change in the amount of toner remaining is obtained with the relatively simple procedure of slope calculation. Furthermore, because the relative change in the amount of toner remaining is calculated over a prescribed number of sheets (10 sheets) of recording paper (P), the amount of relative change in the average amount of toner remaining value is obtained with good precision by ignoring sudden changes in state or erroneous detection such as removal or installation of developing unit (12*b*), ambient changes, or the like. In addition, the number of sheets with which no white voids are produced in the image is set as the prescribed number of sheets of recording paper (P) for calculating the amount of relative change in the amount of toner remaining in this case, so image quality can be kept in a satisfactory state.

In addition, this embodiment is constituted to sequentially store the amount of toner remaining each time the image-forming operation is completed for one sheet, which is one unit of recording paper (R), and to sequentially erase the amount of toner remaining that does not correspond to the one sheet of recording paper (R) for calculating the amount of relative change in the amount of toner remaining, So, the storage capacity for calculating the amount of toner remaining is at a minimum, with the result that the device can be made less expensive and smaller.

Figures 7, 8:
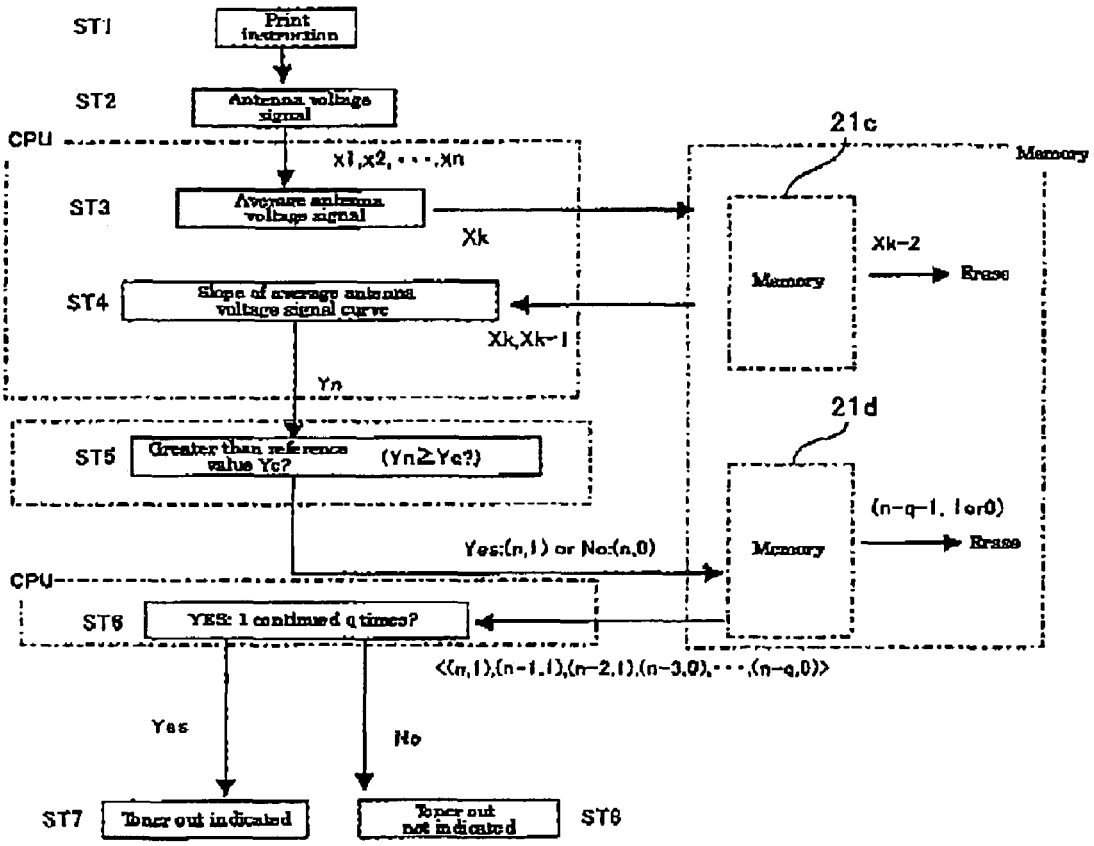
FIG. 7 is a flow chart representing the detection procedure for the amount of toner remaining in another embodiment of the present invention.
FIG. 8 is a schematic diagram representing how the amount of toner remaining data (average antenna voltage signals) are stored in memory in the embodiment in FIG. 7.

On the other hand, with the embodiment shown in FIG. 7, 2 is set as the prescribed number of sheets of recording paper (R) for calculating the amount of relative change in the amount of toner remaining. That is, as shown in this figure, first, by issuing a print instruction (step 1), simultaneously with the image formation operation starting, an antenna voltage signal is output from the amount of toner remaining detection system (step 2) and an average antenna voltage signal $X_k$ as described above is calculated for each sheet of recording paper (R) from the antenna voltage signal (step 3). Average antenna voltage signals $X_k$ are sequentially stored in memory (RAM) (21*c*) furnished for control processing part (21) of abovementioned controller part (20), but with this embodiment, as also shown in FIG. 8, only the average antenna voltage signals ($X_k$, $X_{k-1}$) corresponding to 2 sheets of recording paper (R) going back from the most recent average antenna voltage signal $X_k$ are stored, and average antenna voltage signals $X_{k-p-2}$ prior to that are sequentially erased.

Next, the average antenna voltage signals ($X_k$, $X_{k-1}$) corresponding to the past two sheets of recording paper (R) that include the most recent average antenna voltage signal $X_k$ are read into control processing part (21) from aforementioned memory (21*c*), and by calculating the slope of the approximation curve of the average antenna voltage signals ($X_k$, $X_{k-1}$) corresponding to the 2 sheets of recording paper, slope $Y_k$ of the abovementioned average antenna voltage signal curve (refer to FIG. 4) is obtained (step 4).

Slope $Y_k$ of the average antenna voltage signal curve represents the amount of relative change in the current amount of toner remaining, and slope $Y_k$ is compared to a preset reference value $Y_C$ using a comparator that is omitted from the figure. When it judged that slope $Y_k$ of the average antenna voltage signal curve exceeds reference value $Y_C$ and the amount of relative change in the amount of toner remaining has suddenly increased, decision data (n, 1) for a decrease in the amount of toner remaining are stored in another memory (21*d*), and when it is determined that slope $Y_k$ of the average antenna voltage signal curve is below abovementioned reference value $Y_C$, decision data (n, 0) for a sufficient amount of toner remaining are stored in the aforementioned other memory (33).

In this case, with this embodiment, as shown in FIG. 9 for example, data up to decision data (n−q−1, 1 or 0) corresponding to q sheets of aforementioned recording paper (R) going back from the most recent decision data (n, 1 or 0) are stored in memory (33), and decision data (n−q−2, 1 or 0) prior to that are sequentially erased.

In this embodiment, the number of sheets for which the aforementioned decision data (n, 1 or 0) are stored is set at 10 sheets. As a result, sudden changes or erroneous detection can be ignored by referencing decision data corresponding to a prescribed number of sheets (10 sheets) in the same way as in the embodiment described above. In particular, 10 sheets is set because printing around 10 sheets after indication that the amount of toner remaining is too low is the upper limit of the number of sheets at which no white voids occur.

For such reasons, data up to decision data (n−q−1, 1 or 0) corresponding to the qth page of recording paper (R) going back from the most recent decision data (n, 1 or 0) are read into control processing part (21) from aforementioned memory (33). When it is judged that all data up to decision data (n−q−1, 1 or 0) corresponding to the qth page of recording paper (R) back continuously exceed abovementioned reference value $Y_C$ and the amount of relative change in the amount of toner has clearly suddenly increased (Yes at step 6 in FIG. 6), it is indicated that the amount of toner remaining is too low, for example, "Toner empty" on indication part (27) (step 7). When it is judged that any decision data item (n−q−1, 1 or 0) corresponding to q sheets (10 sheets) of recording paper (R) has gone below reference value $Y_C$ and that there is no sudden increase in the amount of relative change in the amount of toner remaining (No at step 6), it is not indicated that the amount of toner remaining is too low (step 8).

In this way, in this embodiment, too, sensing is done based on the relative change in the amount of toner remaining itself, that is, slope $Y_k$ of the average antenna voltage signal curve just as in the abovementioned embodiment, and sensing of the amount of toner remaining and indicating that it is too low are accomplished without using a reference value for the amount of toner remaining, as was done in the past. So, a process for adjusting the sensing output becomes unnecessary, and particularly in this embodiment, calculation of the relative change of the amount of toner remaining value is performed based on the amount of toner remaining for 2 sheets of recording paper (R), so the amount of toner remaining is obtained with an extremely simple calculation procedure.

In addition, this embodiment is constituted so that slope $Y_k$, which is the amount of relative change in the amount of toner remaining calculated over 2 sheets of recording paper (R), is stored temporarily only for the number of times that reference value $Y_C$ is exceeded, so a minimum storage capacity is sufficient for calculating the amount of remaining toner and the device can be made less expensive and smaller.

The explanations given above by the present inventor are in concrete terms based on embodiments, but the present invention is not limited to the aforementioned embodiments and it goes without saying that various modifications are possible within a scope that does not deviate from the essential points.

The paper delivery unit pertaining to the present invention described above can be applied widely for various types of image-forming devices in addition to image-forming devices such as copiers, printers, fax machines and the like.

By way of explanation the following symbols have been discussed.

3 Antenna (amount of toner remaining detection system)
10 Printing and recording engine part
12 Process cartridge
12*a*Photosensitive drum (image carrier)
12*b*Developing unit
12*b*Toner (developer) storage container
12*b*2 Developing sleeve
13 Paper feed cassette
14 Transfer roller
20 Controller part
21 Control processing part
R Recording paper
$X_1, X_2, \ldots, X_n$ Average amount of toner remaining value (average antenna voltage signal)
A Average antenna voltage signal curve It is to be understood that the present invention may be embodied with other changes and improvements that may occur to a person skilled in the art, without departing from the spirit and scope of the invention defined in the claims.

I claim:

1. An image-forming device, comprising:

a developer storage container for storing toner therein;

an antenna unit for outputting a signal induced in an antenna according to an amount of remaining toner in the developer storage container; and a control processing unit constituted such that the presence or absence of toner in the developer storage container is judged using the output signal from the antenna unit;

wherein the control processing unit is configured such that each relative change in prescribed units for the amount of the remaining toner in the developer storage container is calculated, and the presence or absence of toner in the developer storage container is judged based on the each relative change calculated as described above and a predetermined reference value for judging the presence or absence, and wherein the each relative change in prescribed units is obtained by the signal from the antenna unit.

2. The image-forming device described in claim 1;

wherein the control processing unit is configured to calculate the an electrostatic capacitance relating to the amount of remaining toner in the developer storage container using a fixed number of sheets of recording paper on which images are formed as one unit, and respective electrostatic capacitances relating to respective amounts of remaining toner at the completion of respective image forming operations using the fixed number of sheets are sequentially stored, and respective stored electrostatic capacitances which relate to the respective amounts of remaining toner and do not correspond with calculating the amount of change of the electrostatic capacitance for the remaining toner are sequentially erased.

3. The image-forming device described in claim 1;

wherein the control processing unit is configured such that a number of pages in a range in which no white voids are produced in images when the amount of remaining toner is too low is set as said prescribed units for which the presence or absence of toner in the developer storage container is judged.

* * * * *